US006809652B1

(12) United States Patent
Baxter et al.

(10) Patent No.: US 6,809,652 B1
(45) Date of Patent: Oct. 26, 2004

(54) XENON LIGHT FIXTURE WITH INTEGRAL BALLAST AND REMOTE CONTROL

(76) Inventors: Kevin C. Baxter, 1847 Verdugo Vista Dr., Glendale, CA (US) 91208; Ken S. Fisher, 5528 Vineland Ave., North Hollywood, CA (US) 91601

( * ) Notice: Subject to any disclaimer, the term of this patent is extended or adjusted under 35 U.S.C. 154(b) by 241 days.

(21) Appl. No.: 09/990,885

(22) Filed: Nov. 14, 2001

(51) Int. Cl.[7] ..... G08B 5/00

(52) U.S. Cl. ..... 340/815.4; 340/635; 340/641; 340/643; 340/332

(58) Field of Search ..... 340/815.4, 511, 340/635, 641, 643, 332; 315/308, 316; 362/372

(56) References Cited

U.S. PATENT DOCUMENTS 4,712,167 A * 12/1987 Gordin et al. ..... 362/233
5,148,158 A * 9/1992 Shah ..... 340/527 X
6,181,077 B1 1/2001 Greenland

* cited by examiner

*Primary Examiner*—Daryl Pope
(74) *Attorney, Agent, or Firm*—Fellers, Snider, Blankenship, Bailey & Tippens, P.C.

(57) ABSTRACT

A xenon light fixture having an integral power supply and a remote interface for controlling the functions of the fixture remotely. In one embodiment, the fixture includes: a housing; a power supply having an input for activating and deactivating the bulb; a switch in communication with the input such that, when the switch is in a first position, the bulb is activated and, when the switch is in a second position, the bulb is deactivated; and a remote interface having an input for receiving a signal from a remote control and an output in communication with the power supply input such that the bulb may be activated and deactivated remotely. In another embodiment, the fixture includes a monitor circuit which measures and displays various environmental and performance factors.

2 Claims, 10 Drawing Sheets

XENON LIGHT FIXTURE WITH INTEGRAL BALLAST AND REMOTE CONTROL

BACKGROUND OF THE INVENTION

1. Field of the Invention

The present invention relates to a xenon light fixture. More particularly, but not by way of limitation, the present invention relates to a xenon light fixture having an integral ballast and a remote control.

2. Background of the Invention

Continuous arc xenon bulbs provide bright, stable, daylight balanced light at power levels from a few watts up to tens of thousands of watts. Such bulbs are widely accepted in architectural, entertainment, and medical applications. Typically, such bulbs require a moderate DC voltage (on the order of 18 to 150 volts) at a relatively high current for steady-state operation. In addition, a higher voltage is usually provided for starting (usually between 2 and 10 times the operating voltage) along with a very high voltage, short duration ignition pulse (on the order of several kilovolts for a period ranging from a few microseconds to a few milliseconds). Thus, a ballast or power supply is normally required for operation of a xenon bulb.

Presently, xenon power supplies may be logically divided into two distinct groups: a) those that operate at line frequency, otherwise known as magnetic ballasts; and b) those that operate at higher frequencies, commonly referred to as electronic power supplies. It should be noted that the terms "ballast" and "power supply" are often used interchangeably. Magnetic ballasts typically employee a transformer followed by a rectifier and filter capacitors to provide the steady-state electrical power, much like a conventional linear power supply. Magnetic ballasts rely on the inductance of the transformer, or a separate inductor in series with the transformer, to limit the current provided by the ballast. The inductance of the ballast is such that, at the frequency of the AC power supplied to the ballast, the impedance limits the current through the bulb. This leads to ballasts which are characteristically large and heavy compared to their electronic counterparts.

Electronic power supplies, on the other hand, typically rectify and filter the incoming electrical power. Solid state switches such as transistors, MOSFETs, IGBTs, or the like, are used to "chop" the resulting DC voltage at a relatively high frequency, typically somewhere between 10 kilohertz and 100 kilohertz. This allows the use of inductors having a substantially lower inductance and hence, having a substantially smaller size. In addition, the DC voltage produced from this high frequency power may be filtered with smaller capacitors, also reducing the size of the power supply. For a number of reasons, these factors are particularly significant in the selection of a ballast for use in the entertainment industry. For example, magnetic ballasts often produce "ripple" at the line frequency or, perhaps, at twice the line frequency. In the United States, this results in 60 Hz or 120 Hz flicker. When a filmed scene is lighted with a xenon powered by such a ballast, "beating" between the motion picture frame rate and the flicker can result in flicker at a slower, perceivable rate in the recorded images. In addition, flicker at any rate will totally preclude the use of frame rates higher than the flicker rate. Furthermore, magnetic ballasts designed for the power levels typically used in filing are often too heavy to be moved manually and therefore require undue time and labor for setup and tear down. Ideally, when the size and weight of the ballast allow, a ballast or power supply will be self-contained within a xenon light fixture so that a user merely "plugs in" the light and turns a switch on. Presently, xenon lights are available for the motion picture industry with integral ballasts up to about 10,000 watts. While such lights fill number of needs, i.e., easy setup and tear down, ease of use, negligible flicker or extremely high flicker rates, etc., these lights still suffer from a few remaining limitations, although such limitations are not necessarily unique to fixtures with integral ballasts.

Typically, such xenon lights are provided with a number of controls such as focus, on/off switching, dimming, and the like. When a light is suspended from rafters or catwalks, lifted with a crane, or otherwise placed in a relatively inaccessible position, it becomes inconvenient, or maybe even impossible, to operate the controls.

In addition, in some installations it is advantageous to know a number of environmental factors and performance characteristics of the light, such as ripple voltage which may cause the light intensity to vary, power output of the light which might affect camera settings, ambient and internal temperatures which may impact light performance, atmospheric pressure which can change the starting characteristics of the light, and attitude of the fixture.

Finally, a need exists for controlling such lights via an industry standard digital bus such as DMX-512, or the like. In particular, the bulb on/off, focus, and dimming controls are well suited for remote manipulation by way of an industry standard interface.

It is thus an object of the present invention to provide a xenon power supply with a remote control for controlling at least the on/off function of the bulb and focusing of the light beam.

It is still a further object of the present invention to provide a monitor which monitors and displays environmental and performance factors which may affect operation of the light.

Finally, it is yet a further object of the present invention to provide an industry standard interface for remote control of the light with commercially available equipment.

SUMMARY OF THE INVENTION

The present invention provides a xenon light fixture with integral ballast and a remote control. In one embodiment, circuitry supervises the remote control functions and monitors and displays environmental factors and performance characteristics which could potentially affect the light output of the bulb.

In a preferred embodiment, circuitry is provided which, among other things, monitors the incoming voltage and current, the output voltage and current to the bulb, the ambient temperature, the exhaust temperature which is representative of the internal temperature of the fixture, the atmospheric pressure, and the attitude of the fixture. The collected measurements are displayed on an LCD display, or the like, located on the fixture. When a measurement indicates a problem with the light or the use of the light, an appropriate alarm is triggered or the light is disabled. In addition, circuitry is provided to allow remote operation of the functions provided on the fixture (i.e., lamp on/off, focus, and dimming) either with a wired remote control or by way of a standardized interface such as DMX-512. Finally, accelerometers are provided, along with non-volatile memory, so that mishandling of the light may be recorded and recalled later to aid in servicing faulty fixtures or to identify the cause of broken equipment.

In another embodiment, relays are provided, with contacts either in series or parallel with switches, as appropriate, to provide alternate means for activation or deactivation of various functions provided on the fixture. A remote control allows the relays to be selectively energized or de-energized remotely by an operator. Thus, the lamp may be turned on or off, the focus manipulated, and dimming of the bulb controlled, even when access to the fixture is difficult or impossible.

Further objects, features, and advantages of the present invention will be apparent to those skilled in the art upon examining the accompanying drawings and upon reading the following description of the preferred embodiments.

BRIEF DESCRIPTION OF THE DRAWINGS

FIG. 1 provides a perspective view of a xenon light fixture with integral ballast as typically used for filming motion pictures, television shows, commercials, and the like.

DESCRIPTION OF THE PREFERRED EMBODIMENTS

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Figure 1:
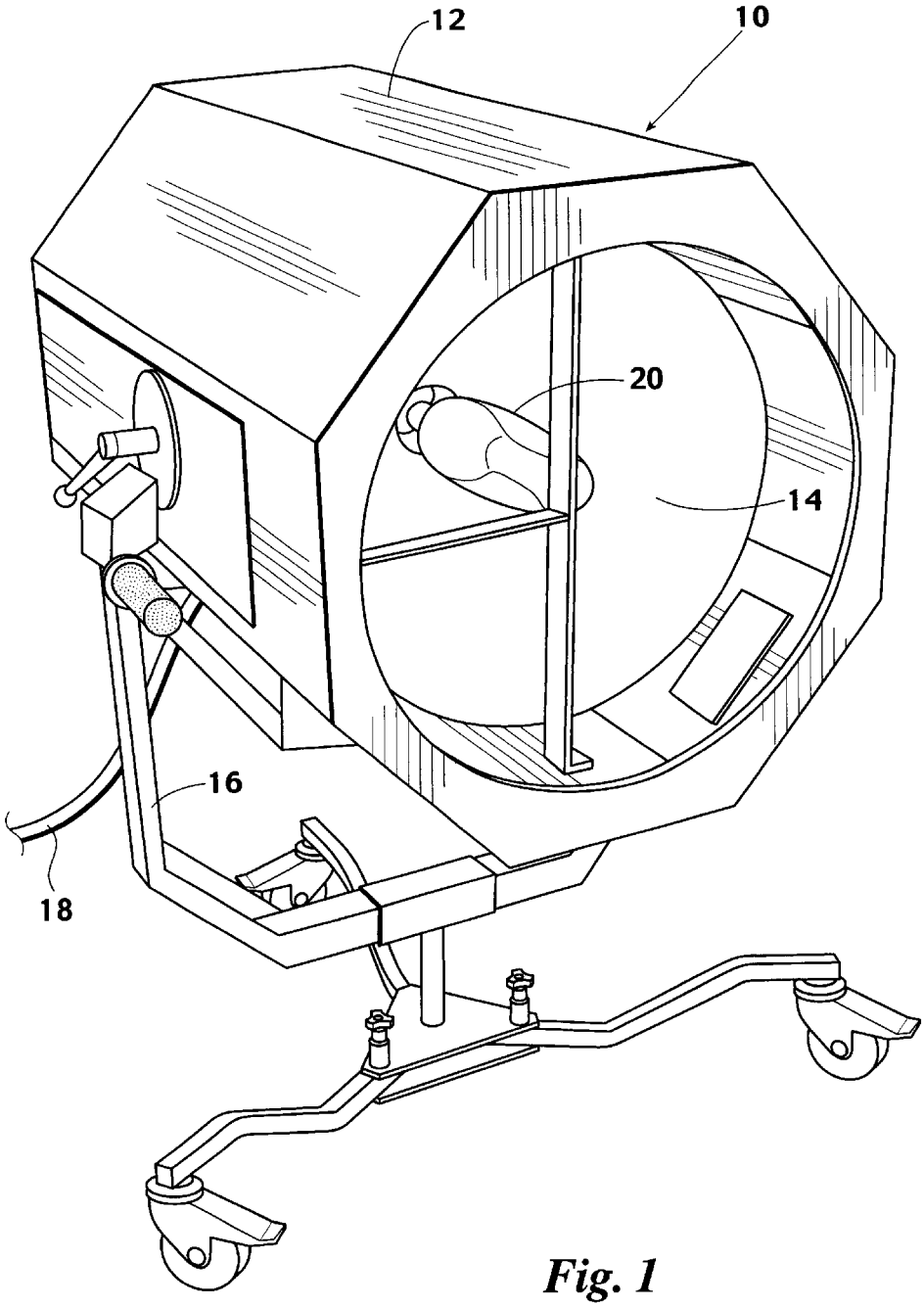

Referring now to the drawings, wherein like reference numerals indicate the same parts throughout the several views, a typical xenon light fixture 10 having an integral ballast is shown in FIG. 1. Preferably, fixture 10 includes: housing 12; lense 14; bracket 16 for mounting fixture 10 on a suitable support; power cord 18 for receiving power, typically from a utility company or from a generator; and xenon bulb 20.

Figure 2:
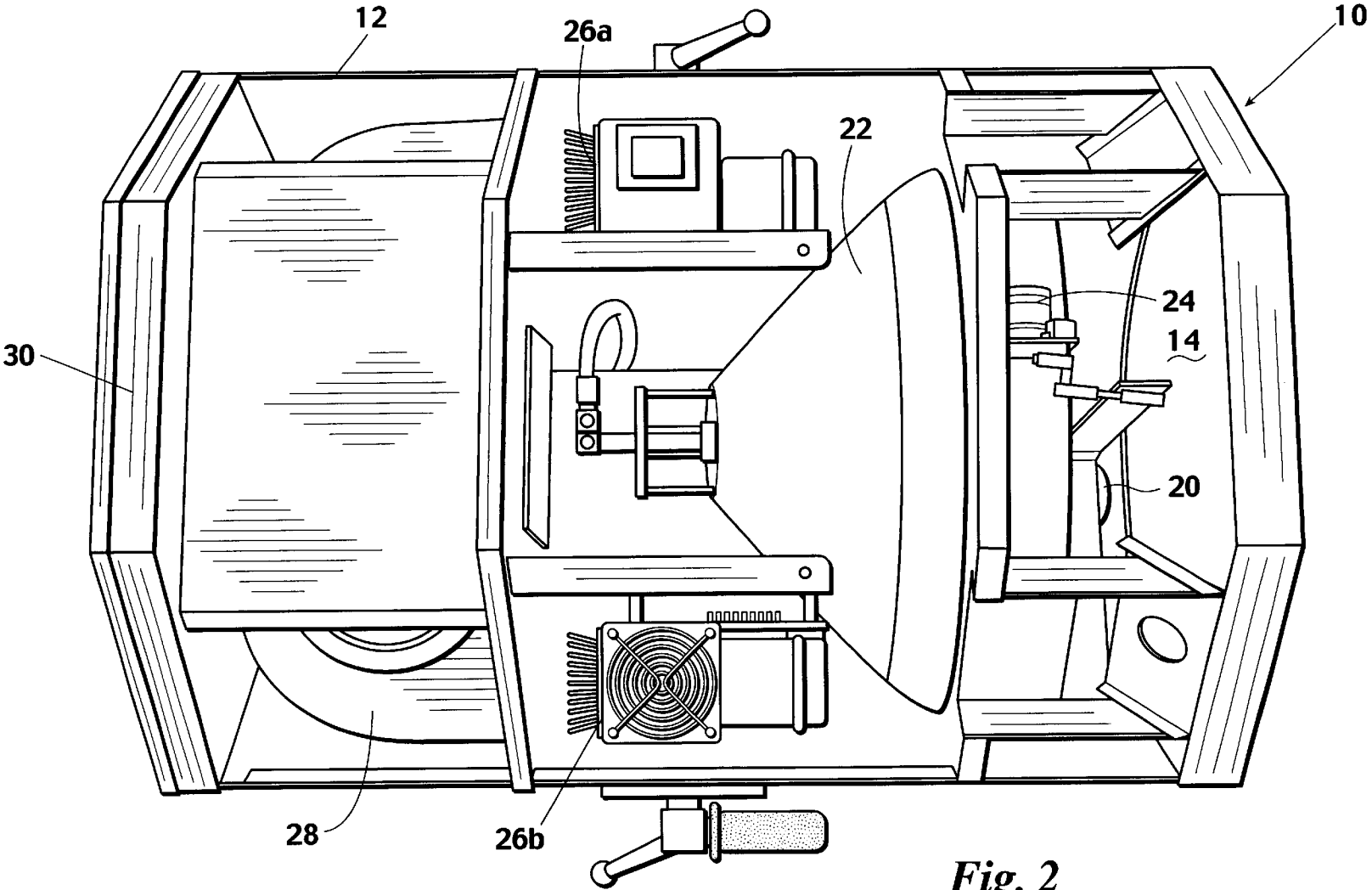
FIG. 2 provides a top view of the interior of the xenon light fixture.

Turning next to FIG. 2, fixture 10 further includes: a parabolic reflector 22 for focusing the light from bulb 20 into a relatively tight beam; a focus motor 24 which moves bulb 20 relative to reflector 22 to vary the size of the beam of light; ganged power supplies 26*a* and 26*b*; fan 28 which provides airflow to cool power supplies 26*a–b* and bulb 20; and back cover 30.

Figure 3:
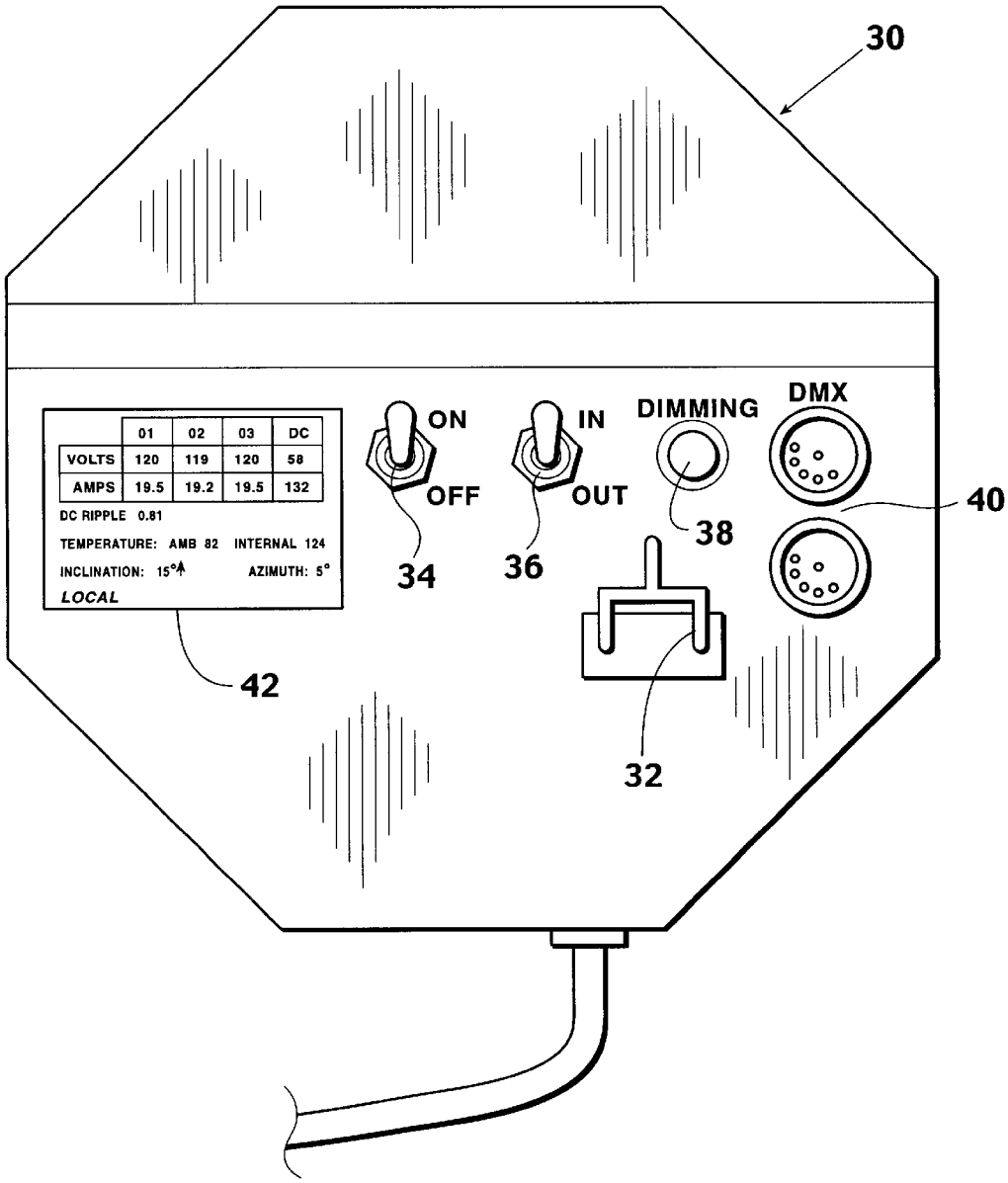
FIG. 3 provides a back view of the xenon light fixture.

With further reference to FIG. 3, preferably, a number of controls are provided on back cover 30. By way of example, and not limitation, such controls would typically include: circuit breaker 32 for controlling AC power supplied to fixture 10; lamp on/off switch 34 for enabling or disabling electrical power to bulb 20; focus in/out switch 36 which serves to control electrical power to bi-directional focus motor 24 to allow selective positioning of reflector 22; dimming control 38, typically a knob for rotating a potentiometer; and a digital interface 40, preferably conforming to an industry standard such as the DMX-512 standard. In addition, the display 42 for the inventive monitor 44 (FIG. 4) is visible through back cover 30.

The DMX-512 standard describes a digital interface for the interconnection of lighting equipment, primarily in the entertainment industry. Requirements for, and the specification of, the DMX-512 interface are described in *Recommended Practice for DMX*-512 published by PLASA, 1994.

Figure 4:
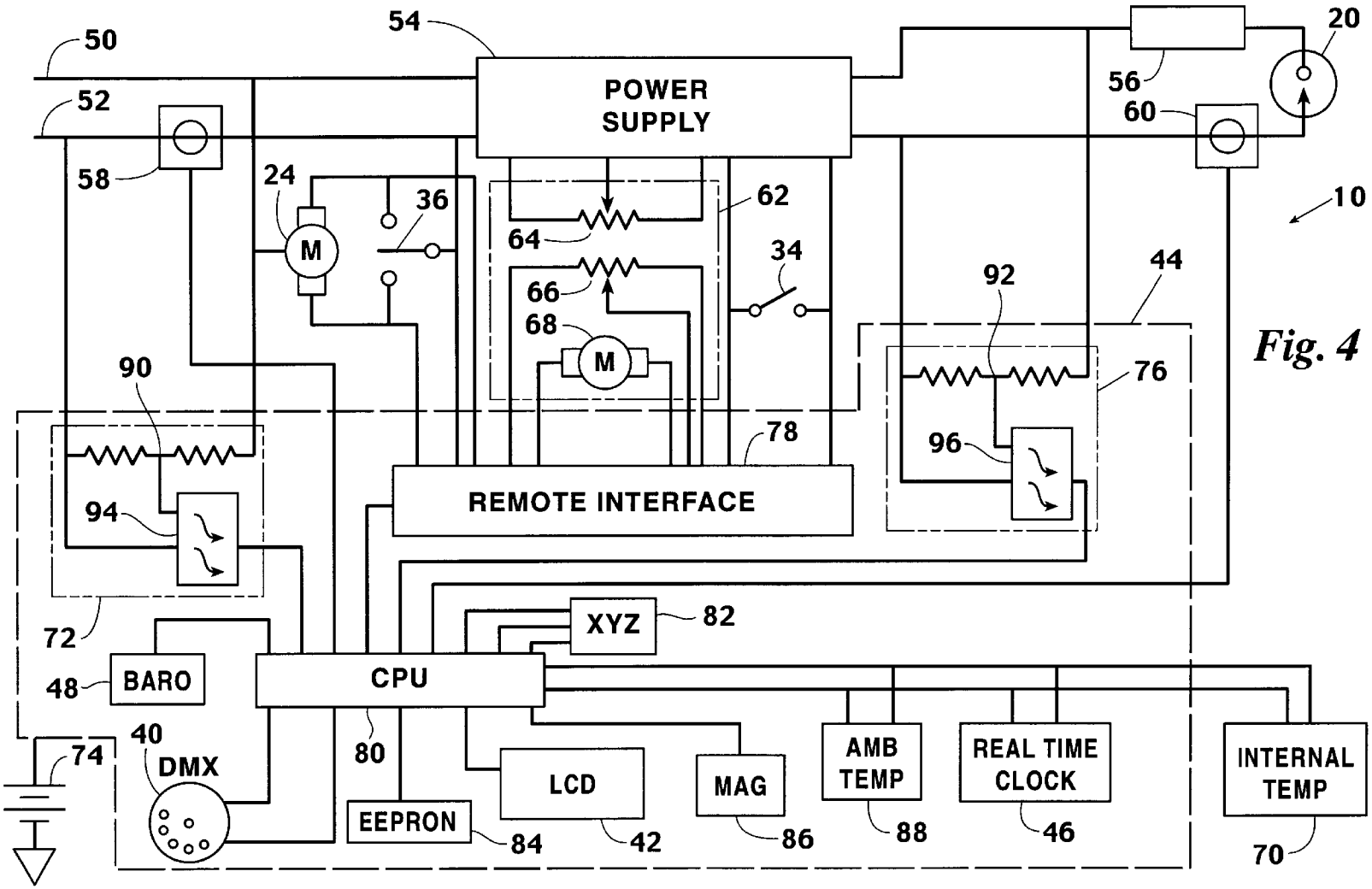
FIG. 4 provides a block diagram of the circuitry employed in the xenon light fixture.

Referring now to FIG. 4, the circuitry employed in the inventive fixture 10 preferably includes: conductors 50 and 52 for receiving AC electrical power in a single phase configuration; power supply 54 for transforming the received AC power to the DC voltages required for operation of bulb 20; ignitor 56 for providing a high voltage ignition pulse to strike an arc within bulb 20; input current sensor 58 for measuring the input current to the fixture; output current sensor 60 for measuring the electrical current provided to bulb 20; fucus motor 24; focus switch 36 for controlling the direction of motor 24; pot assembly 62 which includes a dimming potentiometer 64 to control the brightness of bulb 20, feedback potentiometer 66 synchronized to pot 64, and dimming motor 68 which can rotate both pots 66 and 64 in unison, as will knob 38 (FIG. 3); lamp on off switch 34; and internal temperature sensor 70 placed in the exhaust air flow from fixture 10 for determining the interior temperature of the fixture 10; monitor circuit board 44; and battery 74 for providing power to monitor 44 when the fixture is not attached to AC power.

Current sensors 58 and 60 are preferably of the type which measure the current through a conductor by means of magnetic coupling. While a conventional current sense coil is appropriate for sensor 58 which measures the AC current entering the fixture, such a sensor is not appropriate for sensor 60 which measures the DC current supplied to the bulb 20. Instead, current sensors are commercially available which resemble a conventional sense coil in appearance, but which instead utilize a Hall-effect sensor so that a static magnetic field produced by direct current can also be measured. Preferably, sensor 60 is of the Hall-effect type thus described. These sensors share a feature with traditional sense coils in that the output of the sensor is inherently isolated from the signal being measured. Other methods for measuring electrical current could also be used. For example, although less suitable, it will be apparent to those skilled in the art that either sensor 58 or 60 could be of the resistive type. While resistive sensors are widely used, such sensors, among other things, result in an unwanted voltage drop, the generation of unwanted heat, and are not electrically isolated from the signal being measured.

It should be noted that the preferred embodiment is shown and described as powered by single phase AC electrical power. As will be apparent to those skilled in the art, xenon lights which operate at relatively high power are often powered from three-phase electrical power. In a three-phase configuration, power supply 54 would receive power from four conductors in a Y-configuration or three conductors in a delta configuration. Except as discussed further herein below, the particular type of power supplied to the light fixture is immaterial to the present invention.

It should also be noted that, in the case of the preferred embodiment, power supply 54 actually comprises two power supplies 26*a* and 26*b* (FIG. 2) operating in a ganged configuration. The ganging of lower wattage power supplies to build a higher wattage power supply is well known in the art.

Continuing with FIG. 4, monitor circuit board 44 comprises: an isolated voltage sensor 72 for measuring the input voltage to the fixture; a second isolated voltage sensor 76 for measuring the output voltage of power supply 54; a remote interface 78 for manipulating the functions provided on back cover 30 (FIG. 3); a computing device 80 which is preferably a microcontroller, microprocessor, or the like; an industry standard digital interface 82, preferably conforming to the DMX-512 standard; non-volatile memory 84 for recording usage and failures of the fixture 10; a display 42, preferably of a liquid crystal variety; a three-axis accelerometer 82; an electronic compass 86 such as a magnetometer or flux gate; a real time clock 46; and temperature sensor 88, preferably in the incoming air stream for measuring the ambient temperature.

With regard to sensors 72 and 76, while a number of methods could be utilized for making voltage measurements, sensors 72 and 76 use resistive voltage dividers 90 and 92, respectively in conjunction with analog opto-isolators 94 and 96.

Figure 5:
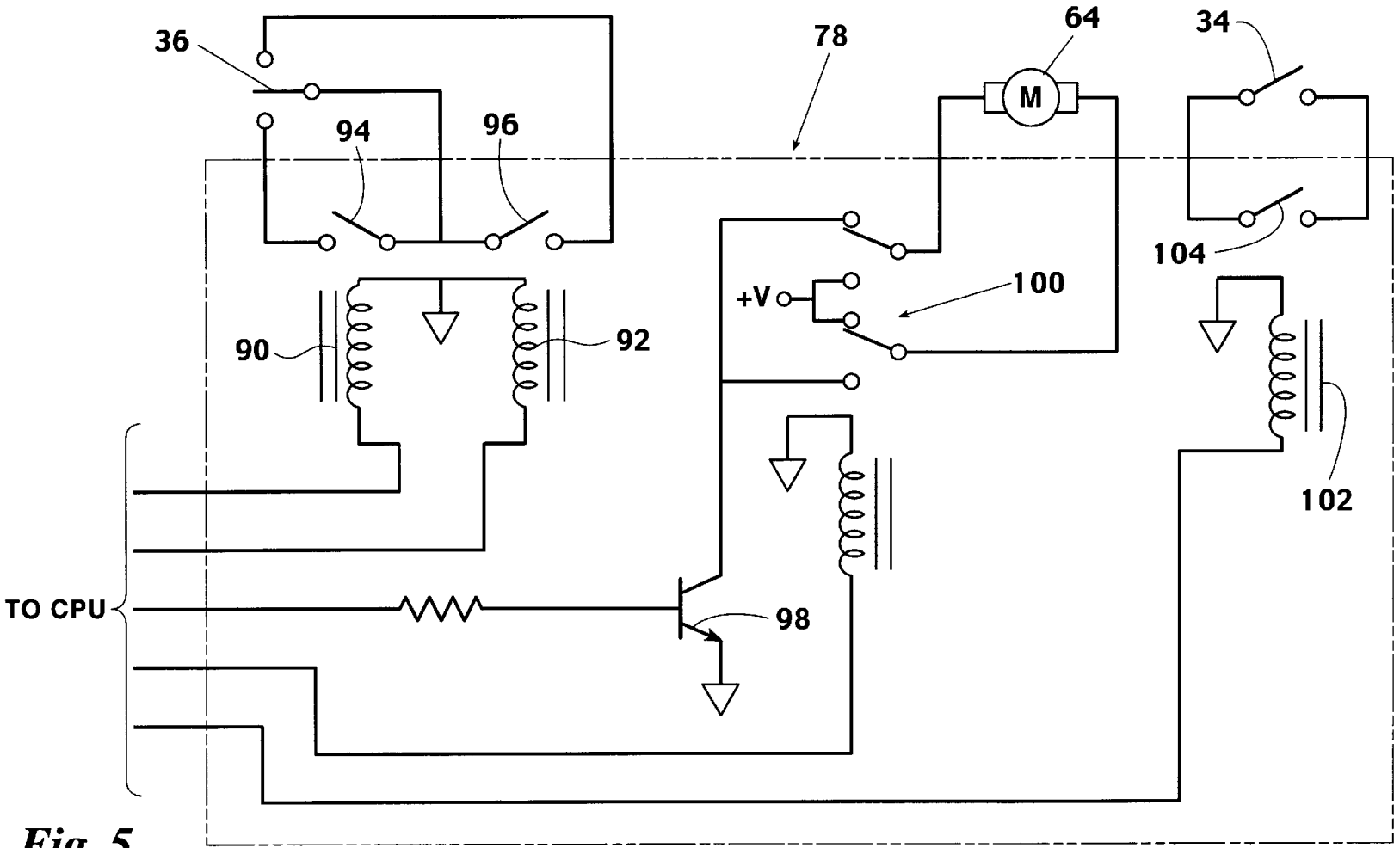
FIG. 5 provides a schematic diagram of the preferred remote interface circuitry incorporated on the monitor board.

With further reference to FIG. 5, the remote interface 78 allows the computer 80 to control the various functions provided of fixture 10. To operate the focus motor 24, the normally open contacts 94 and 96 of a pair of relays 90 and 92, are wired to provide the functionality of a momentary, single pole, double throw switch. Contacts 94 and 96 are then wired in parallel with focus switch 36.

To adjust the brightness of the xenon bulb 20, the dimming pot assembly 62 includes a reversible DC motor 68 which can rotate pot 64. Remote interface 78 includes motor driver 98 and reversing relay 100. The direction of rotation of motor 64 is controlled by reversing relay 100, which is configured to reverse the polarity of the power provided to motor 64 when relay 100 is energized. Motor driver 98 provides switching of the electrical current driving the motor, regardless of the polarity applied to the motor through relay 100. Driver 98 is typically a transistor, MOSFET, IGBT, or the like. It should be noted that the wiper of feedback pot 66 is directed to an analog input of computer 80 so that the computer can precisely position the synchronized pots 64 and 66, allowing precise control to the level of dimming.

Finally, in the preferred embodiment, the power supply will extinguish the lamp when the lamp on/off switch 34 is in the closed position. Thus, the remote interface provides a relay 102 having normally open contacts 104 connected in parallel with switch 34. If switch 34 is in the "on" position, relay 102 may be used to selectively turn the lamp on or off. In contrast, if power supply 54 were configured to extinguished the lamp when the contacts of switch 34 were open, then normally closed contacts of relay 102 would be wired in series with switch 34 to achieve identical operation from an operator's perspective.

Figure 6:
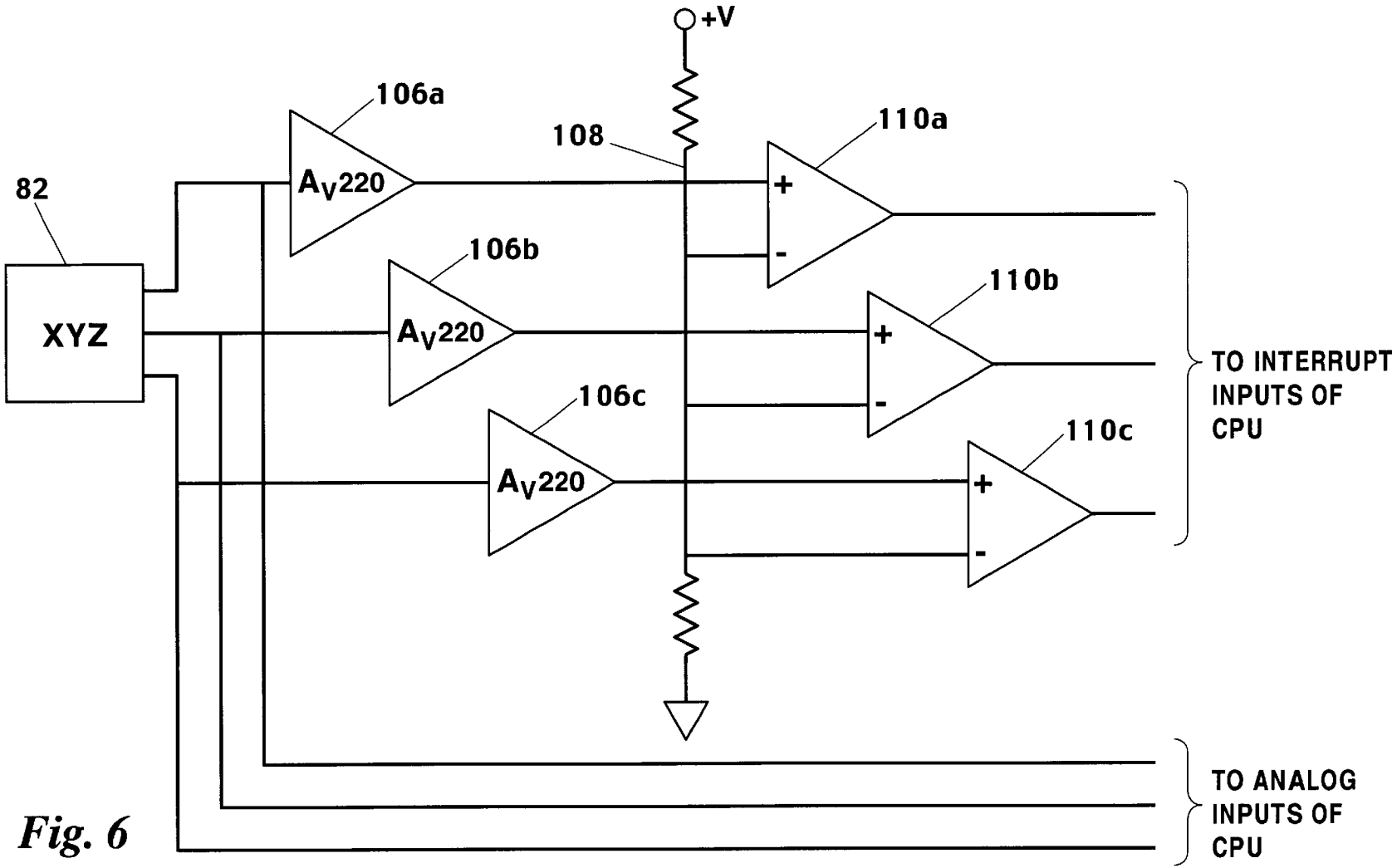
FIG. 6 provides a block diagram of the preferred accelerometer circuitry incorporated on the monitor circuit board.

Continuing with reference to FIG. 4, accelerometer 82 may be used for several purposes. By way of example, and not limitation, when light 10 is in storage or transit, computer 80 enters a "sleep" or "standby" mode in which very little electrical power is required to operate monitor 44. Battery 74 supplies electrical power to monitor 44 whenever AC power is not provided to fixture 10. If the additional circuitry of FIG. 6 is provided between accelerometer 82 and CPU 80, the CPU will be awaken by interrupts caused by handling of the fixture 10, allowing the CPU 80 to store a record, or other improper, handling. The output of each axis of accelerometer 82 is first amplified by one of amplifiers 106*a–c*. Each amplifier output is then connected to a voltage comparator 110*a–c* for comparison with a threshold voltage 108. When there is sufficient jostling or impact, in at least one axis, the output of the comparator 110*a*, 110*b*, or 110*c* associated with that axis momentarily changes state, causing an interrupt (or exception) which brings the CPU 80 out of the sleep state. The computer 80 may then read the outputs of the accelerometer 82, which are also directed to analog inputs of the computer 80, and, if the level acceleration is potentially damaging, store the information in non-volatile memory 84.

Additionally, the signal from the accelerometer 82 may be used to calculate the tilt of the light fixture 10. Since convection of the air heated by the lamp 20 will tend to rise, the temperature of the rearward portion of the fixture 10 may be significantly impacted by the tilt of the fixture. Thus, an alarm may alert the operator to tilt angles which could be potentially damaging. Yet another example of the use of the accelerometers is to display the tilt angle of the fixture 10 on display 42. In this way, an operator may use the tilt information to precisely aim the light or to return the light to a previous position. This feature is particularly useful in filming, where a scene may need to be recreated at a later date. Similarly, the output of electronic compass 86 may be displayed such that an operator may aim the light at a predetermined azimuth.

When the fixture 10 is connected to a compatible device, DMX-512 interface 40 allows control of fixture 10 from a remote device. The DMX-512 standard is well known in the art. In summary, an RS-485 data stream is provided from a control device (often a light control board or a computer) to one or more lighting devices. Each device is provided with a base address and occupies a contiguous address space of one or more locations beginning at the base address. Data is sent by the host at 250 kbaud beginning with a break character having a duration of at least 88 microseconds, a binary zero in the first character position, followed by up to 512 byte of dimming information. The address of the device indicates the position of the data in the data stream. For example, if a device has an address of sixteen (16) and provided eight controllable functions, the device would ignore the first fifteen data bytes, capture bytes 16 through 23 and ignore any additional bytes sent by the controller. Generally speaking, the DMX-512 interface comprises a 5-pin XLR connector connected to the bus interface pins of an RS-485 transceiver in accordance with the DMX specification. The serial data output by the RS-485 transceiver is then connected to a serial input on computer 80, thus allowing control of the functions of fixture 10 by virtually any DMX-512 compatible controller.

Figure 8:
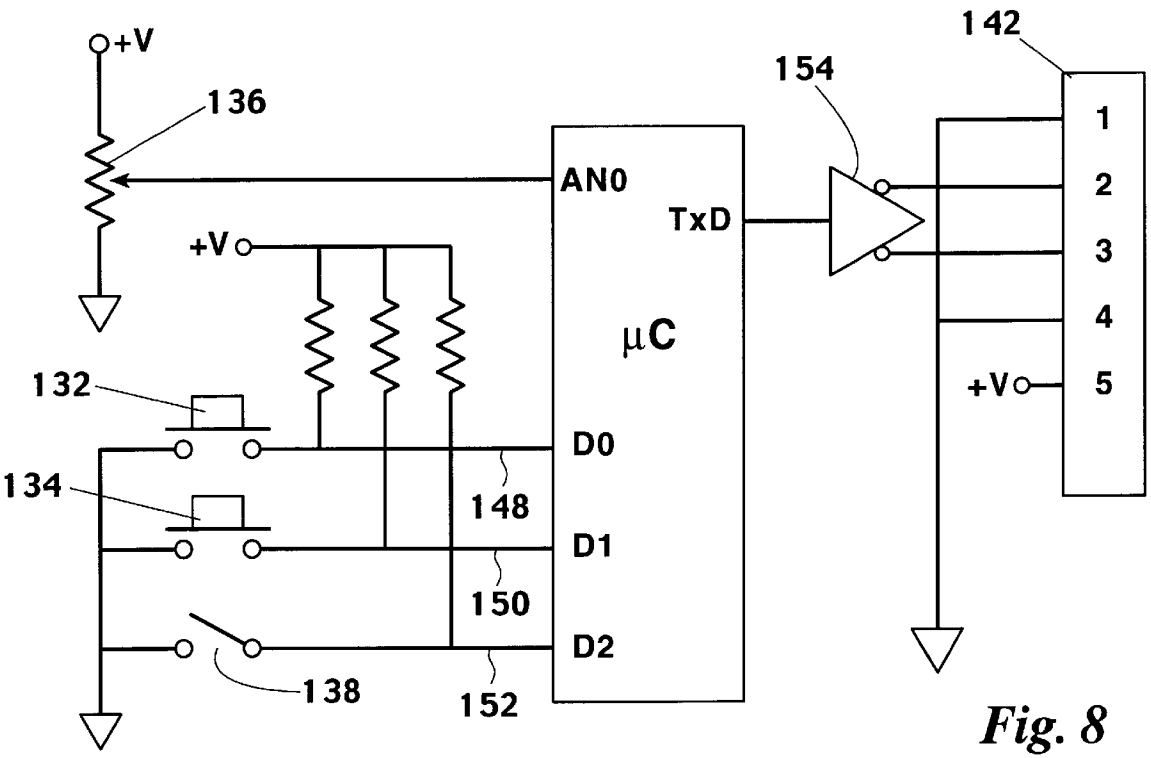
FIG. 8 provides a schematic diagram for a wired remote control for a xenon light fixture.
Figure 7:
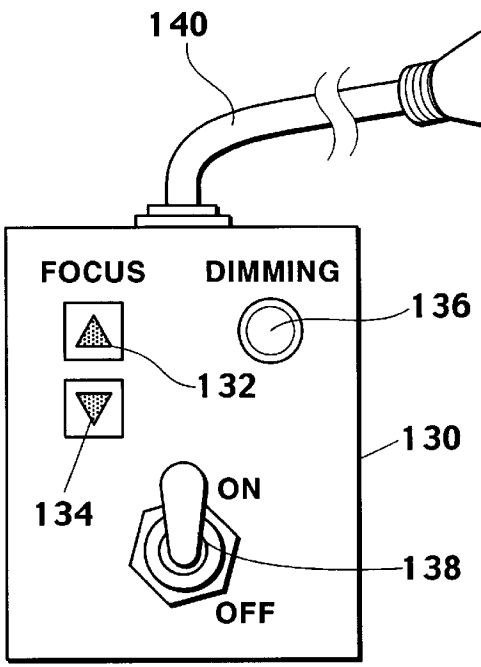
FIG. 7 provides a front view of a preferred remote control for use with the inventive xenon light fixture.

Alternatively, a dedicated remote control 130 could be furnished as shown in FIGS. 7 and 8. Remote 130 provides: focus in and focus out switches 132 and 134, respectively; dimming pot 136; lamp on/off switch 138; a cord 140 extending from remote 130; and connector 142 for connection to DMX-512 interface 40. In addition, preferably, remote 130 includes a microprocessor or microcontroller 144 having an analog input 146 for receiving the position of pot 136 and three digital inputs 148, 150, and 152 for reading the positions of switches 132, 134, and 138, respectively. A serial output 154 provides serial data to an RS-455 driver 156 for transmitting serial data through connector 142 to the light.

Each input 146–152 is encoded into the DMX-512 data stream for receipt and processing by fixture 10. In one such encoding scheme, a non-zero value is used in a discrete location of the data stream to indicate switch contacts in a closed position and a zero transmitted in the location to indicate switch contacts in an open position. The position of the potentiometer is converted to an eight bit binary number (between 0 and 255, inclusive) and transmitted in yet another discrete location of the data stream.

As will be apparent to those skilled in the art, in such a scheme, the remote control 130 would necessarily be configured to transmit at the same DMX-512 address as programmed into the fixture 10. To avoid such a requirement, the remote control 130 may be programmed to send a particular number, other than zero, in the first byte following the break character which initiates a DMX-512 transmission. Since the DMX-512 standard requires this character to be zero, the fixture 10 could distinguish a dedicated remote control, such as remote 130, from other DMX-512 controllers and assume a predetermined address when a dedicated remote is in use, rather than using the DMX-512 addressing otherwise selected by the operator. This scheme makes it impossible for an operator to inadvertently mis-set the address, either on the remote or on the light. Thus, regardless of the address location selected for the fixture, upon receiving commands over the DMX-512 connector from remote 130, fixture 10 will respond appropriately to the controls. However, when connected to a conventional DMX-512 controller, fixture 10 will recognize commands at its selected addresses and ignore the data transmitted at other address in conformance with the DMX-512 specification.

Figure 9:
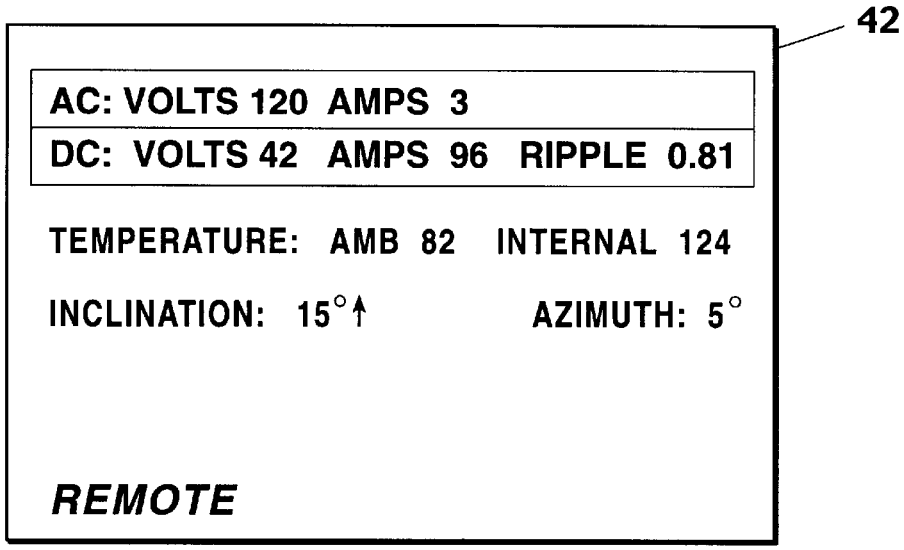
FIG. 9 provides a front view of the LCD display incorporated on the monitor circuit board showing a representative display for a xenon light operating on single phase AC power.

As mentioned briefly hereinabove, monitor 44 also includes display 42 which provides environmental information and performance data to an operator. Referring again to FIG. 4 and with further reference to FIG. 9, typical information displayed on display 42 would include the input voltage as measured by sensor 72, the input current as measured by sensor 58, the bulb voltage and the ripple on the bulb voltage as measured by sensor 76, the bulb current as measured by sensor 60, the internal and external temperatures as measured by sensors 70 and 88, respectively, the azimuth and inclination of the fixture as measured by electronic compass 86 and accelerometers 82, altitude information as measured by barometric sensor 48, and usage information such as the number of hours on the bulb. It should be noted that, perhaps with the exception of the temperature sensors 70 and 88, it is unlikely that any of the above mentioned sensors will provide a measurement directly in the units of measure to be displayed. Accordingly, the measurements will require some degree of scaling by computer 80. The scaling of such values into known units is a well known process, well within the skill level of one of ordinary skill in the art.

Figure 10:
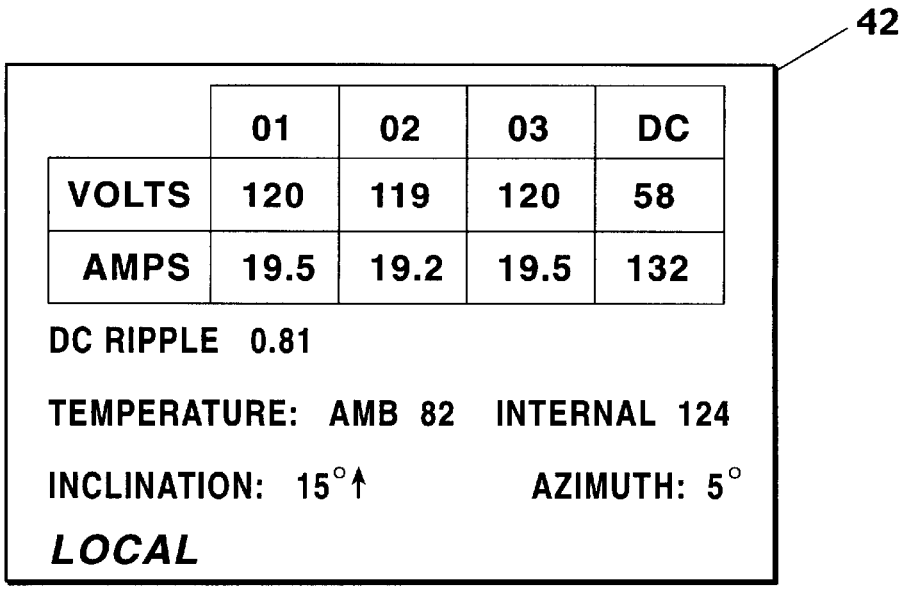
FIG. 10 provides a front view of the LCD display incorporated on the monitor circuit board showing a representative display for a xenon light operating on three phase AC power.

Referring also to FIG. 10, a fixture configured to receive three phase power would have a display 42 showing expanded information to indicate the voltage and current present on each incoming phase.

It should also be noted that display 42 could be used for a variety of other purposes, including, but not limited to: providing instructions to an operator for connecting and using the light; to display a warning and data when the light has experienced mishandling, misuse or abuse (as detected with the various environmental sensors 48, 70, 82, 86, and 88); diagnostics to aid in repair of the light; to display data concerning; usage information such as hours of use on the bulb or estimated hours of bulb life remaining; contact information for customer service; warnings when the light is connected to an unsuitable or marginal power source; and the like. Furthermore, it would ordinarily be useful to display whether the light 10 is under the control of the controls located locally on the fixture, or under the control of a remote control. To facilitate navigation through such screens, the display could be of the type having a touch screen, such displays are well known and widely used in the art.

Figure 11:
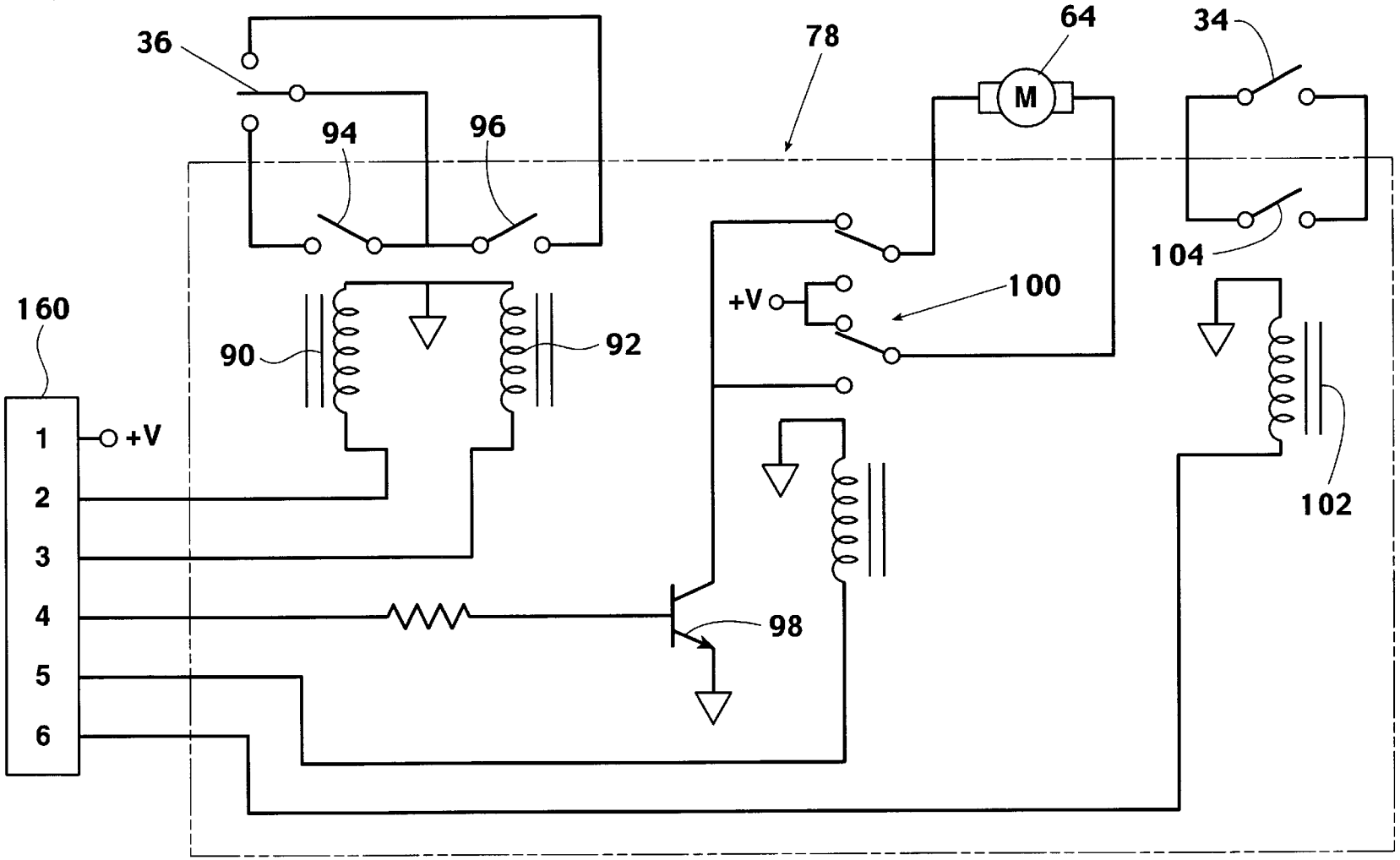
FIG. 11 provides a schematic diagram for a remote interface for a xenon light fixture without a monitor circuit.
Figure 13:
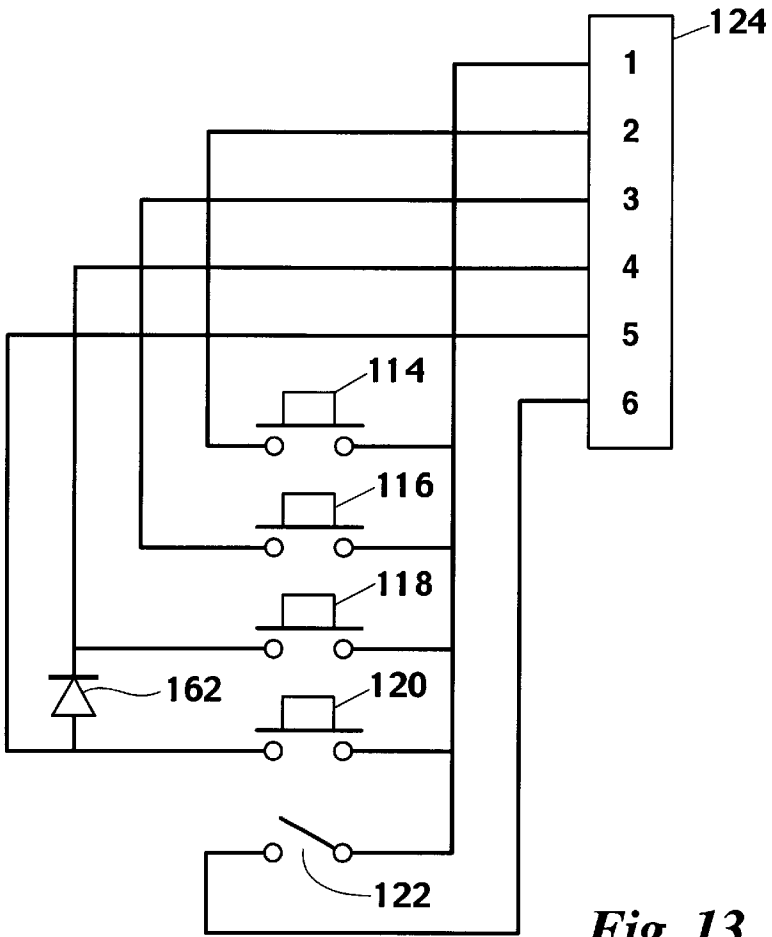
FIG. 13 provides a schematic diagram for the remote control of FIG. 12.
Figure 12:
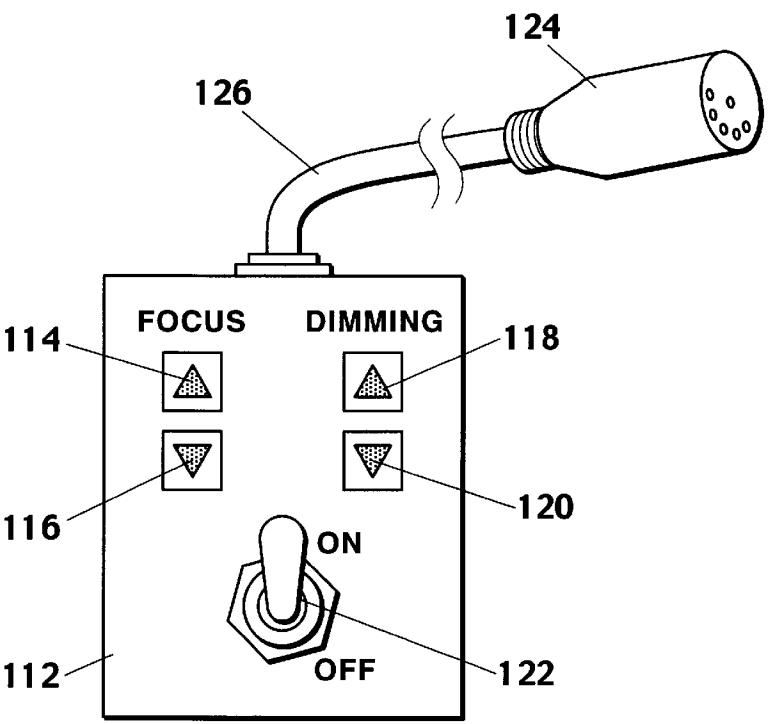
FIG. 12 provides a front view of a remote control for the xenon light fixture of FIG. 11.

Referring now to FIG. 11-13, in another preferred embodiment, fixture 10 is provided with the remote interface 78 and without the other circuitry of monitor 44 as described in the first preferred embodiment (including digital interface 40). As will be apparent to those skilled in the art, the remote interface 78 is identical to that of FIG. 5 except connections are made directly to the remote control connector 160 rather than connected to CPU 80 (FIG. 5). A handheld remote 112 is then provided for connection to connector 160 to selectively energize relays 90, 92, 100, or 102, and driver 98.

Handheld remote 112 includes: switch 122 which toggles between an on position and an off position (whether of the push-on/push-off variety, a toggle switch, a rocker switch, or other similar switch) to control the activation of relay 102 which turns the lamp 20 (FIG. 4) on and off; momentary switch 114 to control the activation of relay 90 and hence operation of the focus motor 24 in the "focus in" direction; momentary switch 116 to control the activation of relay 92 and likewise, the operation of the focus motor in the "focus out" direction; switches 118 and 120 to direct the rotation of pot motor 64; and diode 162 which works in conjunction with switches 118 and 120 to activate the reversing relay 100 only upon the closure of switch 120. In addition, remote control 112 includes cord 126 and connector 124 for connection with connector 160 located on fixture 10.

As will be apparent to those skilled in the art, in either embodiment, when a remote control is not connected to fixture 10, the controls 34–40 function normally to control the features of the light. When a remote control is connected, the dimming and focus functions may be controlled either remotely or with controls 36 and 38 on fixture 10. It should be noted however that, as to the on/off function, both switch 34 and relay 102 must be in the "on" position (the open position in the preferred embodiment) to activate bulb 20. Placing either switch 34 in the off position or activating relay 102 will extinguish the light. It should also be noted that the on/off control could be wired, instead, to favor the "on" state, rather than the "off" state such that the light would be activated unless both switches were in the "off" position (in the preferred embodiments, normally closed contacts of relay 102 would simply be wired in series with switch 34 rather than normally open contacts wired in parallel with switch 34). Such modifications are within the scope and spirit of the present invention.

It should also be noted that the in the preferred embodiment, fixture 10 may be operated with its local controls even if monitor 44 suffers a failure. Alternatively, the controls could be directed to CPU 80 such that all functions of the light are exclusively under the control of CPU 80. CPU 80 would then direct operation of the remote interface 78 in response to local controls, as well as to the remote control. This could allow the CPU 80 to modify operation of the fixture when subjected to excessive temperatures, excessive inclination, etc.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention.

What is claimed is:

1. A xenon light fixture comprising:

a housing;

a xenon bulb housed within said housing;

a power supply housed within said housing, said power supply having a power input for receiving AC electrical power and a bulb output for providing DC electrical power to said xenon bulb; and a monitor comprising:

a sensor for measuring an environmental factor; and a display visible from outside of said housing having displayed thereon the measurement provided by said sensor, wherein said sensor is selected from the group consisting of:

(a) an accelerometer for measuring a tilt of said housing;

(b) a barometric sensor for measuring altitude;

(c) a temperature sensor for measuring an ambient temperature outside said housing;

(d) a temperature sensor for measuring a temperature within said housing; and (e) an electronic compass for measuring the azimuth of said housing.

2. The xenon light fixture of claim 1 further comprising non-volatile memory wherein when the value measured by said sensor exceeds a predetermined level, the measurement is stored in said non-volatile memory.

* * * * *